US006086172A

United States Patent [19]

Lee

[11] Patent Number: 6,086,172

[45] Date of Patent: Jul. 11, 2000

[54] STRUCTURAL ASSEMBLY SYSTEM USED TO FORM DIFFERENT FURNITURE PIECES

[76] Inventor: Lawrence K. Lee, 9320 Harwin Dr., Houston, Tex. 77036

[21] Appl. No.: 09/168,190

[22] Filed: Oct. 7, 1998

[51] Int. Cl.[7] ..... A47B 87/00

[52] U.S. Cl. ..... 312/108; 108/101; 108/155; 108/181; 211/40; 211/189

[58] Field of Search ..... 312/108; 211/189, 211/37; 108/180, 181, 187, 186, 193, 155, 156, 158

[56] References Cited

U.S. PATENT DOCUMENTS

| | | | |
|---|---|---|---|
| D. 259,607 | 6/1981 | Stahl, Jr. et al. . | |
| D. 266,133 | 9/1982 | Stahl, Jr. et al. . | |
| D. 322,374 | 12/1991 | Edur . | |
| D. 370,144 | 5/1996 | Insalaco et al. . | |
| D. 380,322 | 7/1997 | Walters, III et al. . | |
| D. 393,553 | 4/1998 | Beggs . | |
| 1,460,591 | 7/1923 | Kuhn . | |
| 3,170,418 | 2/1965 | Gruenstein . | |
| 3,326,149 | 6/1967 | Mitchell et al. . | |
| 4,114,964 | 9/1978 | Coster . | |
| 4,153,311 | 5/1979 | Takahashi . | |
| 4,321,873 | 3/1982 | Nealis | 108/155 X |
| 4,325,597 | 4/1982 | Morrison . | |
| 4,505,392 | 3/1985 | Erlam | 211/189 X |
| 4,630,739 | 12/1986 | Levenberg | 211/189 |
| 4,709,640 | 12/1987 | Jouanin | 108/181 X |
| 4,714,027 | 12/1987 | Stern | 108/101 X |
| 5,011,228 | 4/1991 | Marcantel . | |
| 5,042,671 | 8/1991 | Bischoff et al. | 211/189 X |
| 5,722,544 | 3/1998 | Williams . | |
| 5,752,610 | 5/1998 | Remmers | 108/181 X |
| 5,754,995 | 5/1998 | Behrendt . | |
| 5,762,208 | 6/1998 | Yeh | 211/40 |

*Primary Examiner*—Peter M. Cuomo
*Assistant Examiner*—Stephen Vu
*Attorney, Agent, or Firm*—Keeling Law Firm

[57] ABSTRACT

A structural assembly system used to construct a variety of pieces of furniture comprising a plurality of main elements, a plurality of connecting elements, and a means for securing. Each of the main elements includes a plurality of openings therethrough, with the openings preferably forming a pattern on the main elements. Each of the connecting elements, which are preferably elongate in shape, extends between and is connected to at least two of the main elements thereby joining those main elements. Specifically, each of the connecting elements rests on one of the openings of each of the at least two joined main elements. The means for securing, in turn, secures the connection between the main elements and the connecting elements. By selecting which main element openings have a connecting element inserted therein, a person can assemble the system into a number of different furniture pieces, including tables, chairs, and shelves. Moreover, the means for securing is removable thereby allowing a person to reconfigure the system into different furniture pieces altogether. A plurality of main elements joined by a plurality of connecting elements can comprise an assembly of different pieces of furniture. Furthermore, instead of being secured to main elements at both of their ends, connecting elements may be secured to a main element at one end and to a permanent rigid structure, such as a wall, at their other end.

23 Claims, 2 Drawing Sheets

Fig. 1
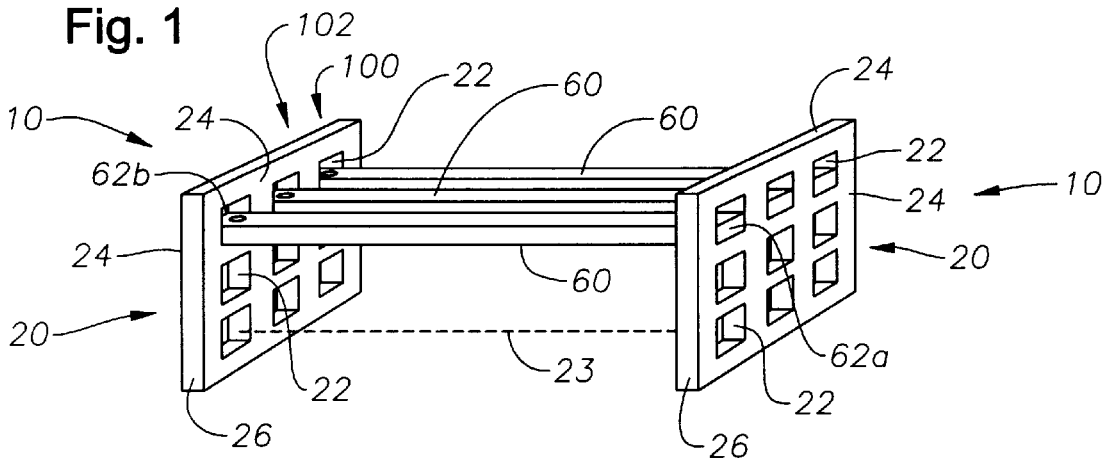
Fig. 2
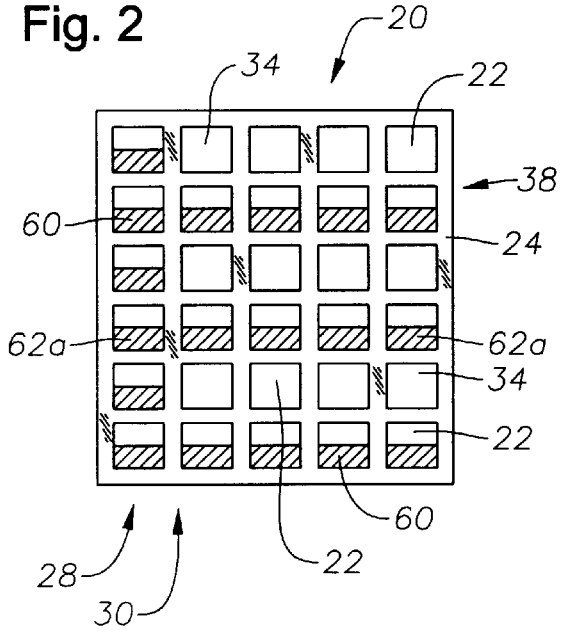
Fig. 3
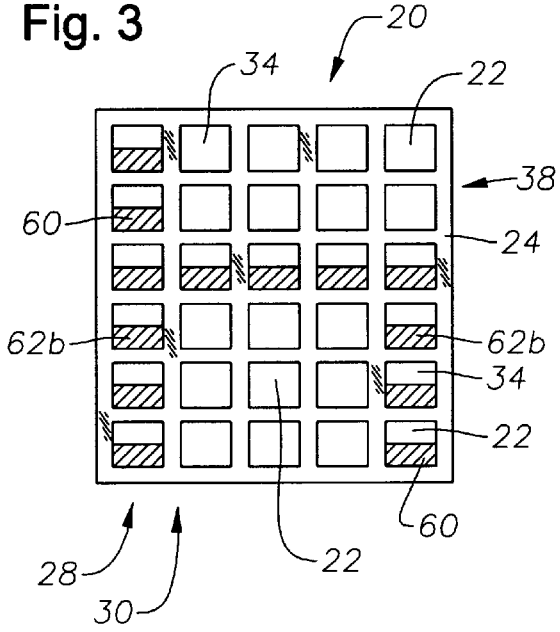
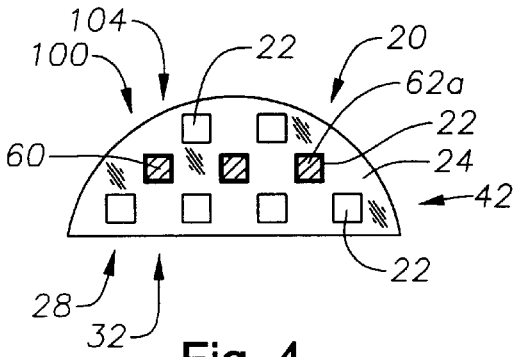
Fig. 4
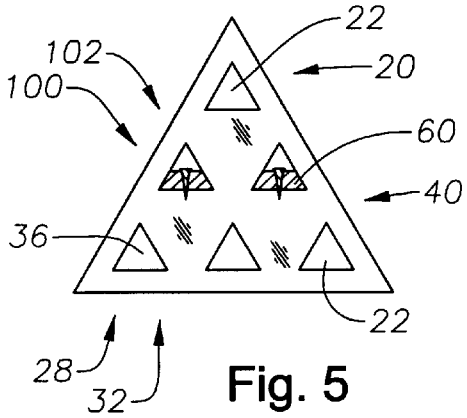
Fig. 5

STRUCTURAL ASSEMBLY SYSTEM USED TO FORM DIFFERENT FURNITURE PIECES

BACKGROUND OF THE INVENTION

1. Field of Invention

This invention relates generally to furniture. Specifically, this invention is a structural assembly system that may be utilized to construct a variety of different pieces of furniture. Once a specific furniture piece is formed by the structural assembly system, the system can also be reconfigured to form another different piece of furniture.

2. Related Art

Because they need to be structurally sound as well as aesthetically pleasing, furniture pieces typically include some common characteristics. However, not all of these common characteristics are necessarily beneficial to consumers.

For instance, furniture is ordinarily quite bulky. This bulkiness makes it cumbersome for a person to carry or transport the furniture piece. Bulkiness, in turn, typically means that a large amount of material was used to make the furniture piece which usually means that the furniture piece is quite expensive. Providing a furniture piece which is easy to carry and transport from location to location would thus be beneficial to the prior art. It would also be beneficial to the prior art to provide a furniture piece which is relatively less expensive than other comparable furniture pieces.

Another characteristic of furniture is that fiurniture is normally non-alterable. For instance, a person that purchases a desk will typically not be able to change the configuration or arrangement of the desk, much less turn the desk into a chair (or any other type of furniture piece) if a chair is needed. To address the non-alterability of furniture, manufacturers have lately designed modular furniture pieces or elements. The modules can be inter-changed and/or switched so that the overall configuration or arrangement of the furniture piece can be altered. Moreover, modular furniture pieces usually allow for the expansion of the overall structure through the addition of extra modules. Illustrative of modular furniture pieces are U.S. Pat. No. 5,722,544 issued to Williams on Mar. 3, 1998 and U.S. Pat. No. 4,153,311 issued to Takahashi on May 8, 1979. Both the Williams and the Takahashi Patents provide a modular assembly structure for shelves which can be altered and expanded. However, neither the Williams nor the Takahashi Patent provide a modular assembly that can be altered to become anything other than a shelving structure.

Likewise, U.S. Design Pat. Nos. 259,607 and 266,133, each issued to Stahl, Jr. et al., disclose the end or side module of a chair, with each patent teaching a different type and shape of chair. The inventions taught by the Stahl, Jr. Patents cannot be modified or changed to be anything other than chairs.

Providing a furniture piece which can be altered so that it can be easily transformed into a different furniture piece altogether would be beneficial to the prior art. Such an alterable furniture piece would save consumers money and space and provide efficiency to the furniture industry and to the interior of consumers' homes.

U.S. Pat. No. 5,754,995 issued to Behrendt discloses a Modular Transformable Furniture which may be transformed between a bed, a dresser, storage cabinets, a desk, an entertainment unit, an end table, and display shelving (among others). However, to enable such transformations, the system requires various optional accessory assemblies, depending on the piece of furniture. Thus, providing a transformable piece of furniture which does not require additional various optional accessory assemblies to enable such transformations would be beneficial to the prior art.

SUMMARY OF THE INVENTION

Accordingly, the objectives of this invention are to provide, inter alia, a structural assembly system used to form furniture pieces:

- which can be formed and altered into a number of different furniture pieces;
- which can be formed and altered into a number of different furniture pieces without requiring additional various optional accessory assemblies;
- is not bulky;
- is easy to carry and transport; and
- is less expensive than comparable furniture pieces.

Other objects of the invention will become apparent from time to time throughout the specification hereinafter disclosed.

To achieve such improvements, my invention is a structural assembly system used to construct a variety of pieces of furniture comprising a plurality of main elements, a plurality of connecting elements, and a means for securing. Each of the main elements includes a plurality of openings therethrough, with the openings preferably forming a pattern on the main elements. Each of the connecting elements, which are preferably elongate in shape, extends between and is connected to at least two of the main elements thereby joining those main elements. Specifically, each of the connecting elements rests on one of the openings of each of the at least two joined main elements. The means for securing, in turn, secures the connection between the main elements and the connecting elements. By selecting which main element openings have a connecting element inserted therein, a person can assemble the system into a number of different furniture pieces, including tables, chairs, and shelves. Moreover, the means for securing is removable thereby allowing a person to reconfigure the system into different furniture pieces altogether. A plurality of main elements joined by a plurality of connecting elements can comprise an assembly of different pieces of furniture. Furthermore, instead of being secured to main elements at both of their ends, connecting elements may be secured to a main element at one end and to a permanent rigid structure, such as a wall, at their other end.

BRIEF DESCRIPTION OF THE DRAWINGS

FIG. 1 is an isometric view of the system forming a table.

FIG. 2 is a side cross-sectional view of the system illustrating an arrangement of connecting elements forming a set of shelves.

FIG. 3 is a side cross-sectional view of the system illustrating an arrangement of connecting elements forming a chair.

FIG. 4 is a side cross-sectional view of the system illustrating an arrangement of connecting elements forming a table as well as a first preferred embodiment of the securing means.

FIG. 5 is a side cross-sectional view of the system illustrating an arrangement of connecting elements forming a table as well as a second preferred embodiment of the securing means.

DETAILED DESCRIPTION OF THE INVENTION

Figure 6:
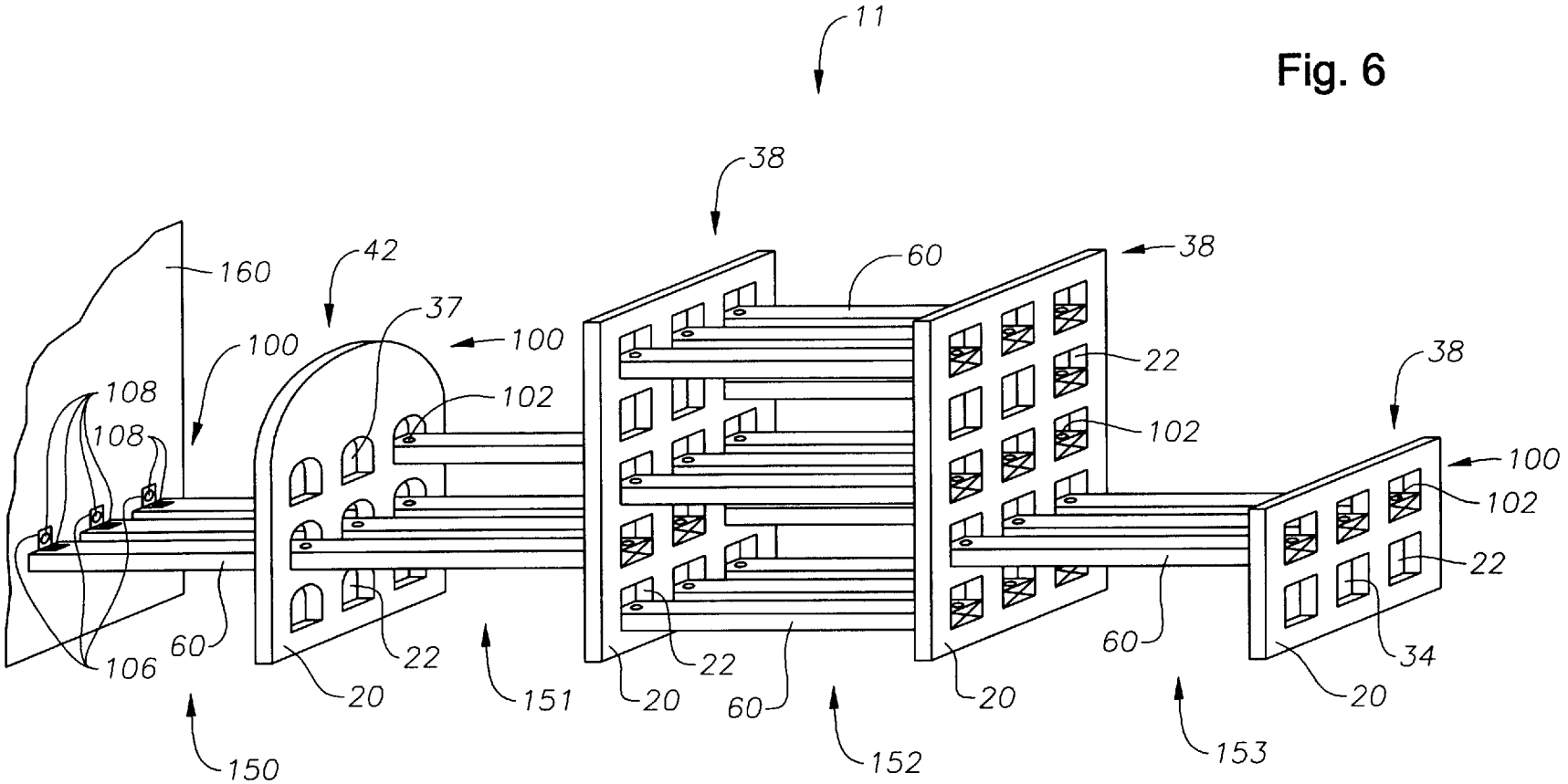
FIG. 6 is an isometric view of the system forming an assembly of furniture pieces, including a first table, a bench/chair, a set of shelves, and a second table, with one end of the connecting elements secured to a wall.

The structural assembly system is shown generally in FIGS. 1–6 as reference numeral 10. Structural assembly system 10 comprises a plurality of main elements 20, a plurality of connecting elements 60, and a means for securing 100. In very general terms, the main elements 20 comprise the sides of the various furniture pieces, the connecting elements 60 connect the main elements 20 together while concurrently providing the respective shape to the various furniture pieces, and the means for securing 100 secures the connection between each connecting element 60 and each main element 20 so that the formed furniture piece is structurally sound.

Each main element 20 includes a plurality of openings 22 therethrough. Preferably, each main element 20 has two sides 24 and a width 26, with the width 26 being substantially smaller than the length of either side 24. Each opening 22 extends from side 24 to side 24 completely through width 26.

Each main element 20 is positioned so that it stands on its width 26 with its two sides 24 being substantially vertical to the ground. Thus, the dimension of width 26 in relation to the two sides 24 must be such to enable such positioning. In addition, width 26 is preferably flat and uniform throughout to also enable such positioning.

In the preferred embodiment, the plurality of openings 22 are arranged in a pattern 28 on each main element 20. In one preferred embodiment as shown in FIGS. 1–3, pattern 28 comprises a row and column pattern 30. In another preferred embodiment as shown in FIGS. 4 and 5, pattern 28 comprises a honeycomb pattern 32. Other patterns may also be used. Preferably, however, each main element 20 includes the identical opening pattern 28.

The shape and relative dimensions of each opening 22 must be such to allow a connecting element 60, as will be discussed herein, to extend through or securely rest thereon. Satisfactory shapes for openings 22 include, but are not limited to, a rectangular opening 34 (as shown in FIGS. 1–4 and 6), a triangular opening 36 (as shown in FIG. 5), and a semi-circular opening 37 (as shown in FIG. 6). The shape and dimensions of each opening 22 are preferably uniform through main element 20.

Each main element side 24, in turn, may also have a variety of shapes. Acceptable shapes for main element sides 24 include, but are not limited to, a rectangular side 38 (as shown in FIGS. 1–3 and 6), a triangular side 40 (as shown in FIG. 5), and a semi-circular side 42 (as shown in FIGS. 4 and 6). For the most part, each shape is capable of forming the same furniture pieces (Compare formation of table by different shapes in FIGS. 1, 4, and 5). Which shape is utilized by a user will depend largely on what the user finds aesthetically appealing. Furthermore, as shown in FIG. 6, different shapes of main element sides 24 may utilized in the same furniture assembly.

Because the main elements 20 generally comprise the sides of each formed furniture piece, each main element 20 is preferably constructed from a rigid and aesthetically appealing and presentable material. Preferred construction materials for the main elements 20 include, but are not limited to, wood, aluminum, steel, cast iron, and plastic compounds. In the preferred embodiment, the construction material for the main element 20 is also lightweight thereby enabling the easy portability of the main element 20 by itself (prior to complete assembly into a formed furniture piece) or as part of a formed furniture piece together with the remainder of the sytem 10.

Each connecting element 60 must be sized to fit within each main element opening 22. Preferably, each connecting element 60 is elongate in shape having two ends, 62*a* and 62*b*. Also preferably, each connecting element 60 is straight. In the preferred embodiment, each connecting element 60 has a rectangular cross-sectional area. However, as can be seen in FIG. 5, the cross-sectional area of connecting element 60 may differ, particularly depending on the shape of the main element opening 22.

Each connecting element 60 is preferably constructed from a rigid and aesthetically appealing and presentable material. Preferred construction materials for the connecting elements 60 include, but are not limited to, wood, aluminum, steel, cast iron, and plastic compounds. In the preferred embodiment, the construction material for the connecting element 60 is also lightweight thereby enabling the easy portability of the connecting element 60 by itself (prior to complete assembly into a formed furniture piece) or as part of a formed furniture piece together with the remainder of the sytem 10.

The means for securing 100 secures each connecting element 60 to each main element 20 thereby ensuring the structural stability of the formed furniture piece and thus the safety of the user. Notably, in order to ease and simplify the transformation of one furniture piece to another, means for securing 100 is also preferably easily removable. In one preferred embodiment as shown in FIGS. 1 and 5, means for securing 100 comprises fasteners 102 which securely fasten each connecting element 60 to each main element 20. The type of fastener 102 utilized, for example nails and/or bolts, will depend largely on the materials (wood or metal) with which the respective main and connecting elements, 20 and 60, are constructed. In another preferred embodiment as shown in FIG. 4, means for securing 100 comprises the tight sliding abutment 104 of each connecting element into each respective main element opening 22. In this embodiment, the cross-sectional area of each connecting element 60 must be the same shape and slightly smaller than the cross-sectional area of each respective main element opening 22. Thus, when the end, 62*a* or 62*b*, of each connecting element 60 is inserted into its respective opening 22 (as will be disclosed herein), the tight sliding abutment 104 between the connecting element 60 and the opening 22 will provide structural stability to the formed furniture piece.

In the constructed form of assembly 10, two or more main elements 20 are positioned on their widths 26 on the ground, with a space between each main element 20. Furthermore, the main elements 20 should be positioned so that their sides 24 are substantially parallel to each other.

As previously noted, in the preferred embodiment, each main element 20 has an identical opening pattern 28. Thus, each opening 22 on each main element 20 corresponds to a similarly located opening 22 on the other main elements 20 (hereinafter collectively referred to as "corresponding openings 23"—see FIG. 1).

Each connecting element 60 is then positioned so that it extends through the corresponding openings 23 of at least two of the main elements 20. The means for securing 100 (either the fasteners 102 or the tight sliding abutment 104) is then used to secure each connecting element 60 to each main element 20 through which it passes.

In one embodiment as shown in FIG. 1, only two main elements 20 are used, and the connecting elements 60 are sized so that each is identical in length. Thus, means for securing 100 secures each connecting element end, 62*a* and 62*b*, to its respective main element 20.

Depending on the shape of the main element 20, the opening pattern 28, and on which corresponding openings 23 are joined with connecting elements 60, a variety of furniture pieces may be formed with assembly 10. For example, FIG. 2 shows rectangular main elements 20 having a row and column opening pattern 28 with connecting elements 60 extending between corresponding openings 23 so as to form a bookshelf. FIG. 3 shows an identical main element 20 shape and the same opening pattern 28, but with connecting elements 60 extending between corresponding openings 23 so as to form a chair. Further examples include a one-level table as shown in FIGS. 1, 4, and 5. As can be easily deduced, virtually any furniture piece (including benches and entertainment centers) may be formed with the assembly 10 simply by manipulating and changing the arrangement of the openings 22 and the connecting elements 60.

In another embodiment as shown in FIG. 6, a plurality of main elements 20 are used and the connecting elements 60 are of different lengths. Having a plurality of main elements 20 enables the formation of an assembly 11 of different furniture pieces. For instance, the assembly 11 of FIG. 6 includes a first table 150, a bench/chair 151, a set of shelves 152, and a second table 153. As can be seen, depending on the furniture pieces included in the assembly 11, not every connecting element 60 extends the entire length of the assembly 11. Of course, if the same furniture piece is included throughout assembly 11, then each connecting element 60 would be the same length and would also likely extend the entire length of assembly 11. From FIG. 6, it can be further observed that different shaped and sized main elements 20 and openings 22 may be combined together in an assembly 11 as well as in a system 10.

Moreover, it can also be observed that both ends of the connecting elements 60 need not be secured to a main element 20. For example, in relation to the first table 150, one end of the connecting elements 60 are secured to a main element 20 whereas the other end of the connecting elements 60 are secured to a permanent rigid structure 160 (such as a wall). Naturally, the means for securing 100 the connecting elements 60 to such permanent rigid structure 160 are different than the fasteners 102 or the tight sliding abutment 104 previously disclosed. Acceptable means for securing 100 connecting elements 60 to a permanent rigid structure 160 include angle brackets 106 attached by fasteners 108 to both the connecting elements 60 and the permanent rigid structure 160 (see FIG. 6) as well as holes on the permanent rigid structure 160 into which the connecting elements 60 are inserted (not shown).

Importantly, because the means for securing 100 is easily removable, a user may readily disengage the means for securing 100 and reposition and resecure the connecting elements 60 in another configuration. Thus, a user may very easily change the assembly 10 from one furniture piece to another. For example, a user may readily switch to and from the bookshelf of FIG. 2 and the chair of FIG. 3.

Because the materials that make up the main elements 20 and the connecting elements 60 are lightweight, a person may easily transport the assembled system 10. However if the system 10 is too bulky for transportation in the current configuration, a person can easily remove the means for securing 100, and simply carry each main element 20 and each connecting element 60 by itself. In addition, because relatively few materials are used to fabricate the system 10 and because the assembly of the system 10 into a furniture piece does not require complicated connections or tools, the system 10 is inexpensive to make and assemble which translates to a lower cost for the consumer.

The foregoing disclosure and description of the invention is illustrative and explanatory thereof. Various changes in the details of the illustrated construction may be made within the scope of the appended claims without departing from the spirit of the invention. The present invention should only be limited by the following claims and their legal equivalents.

What is claimed is:

1. A structural assembly system used to construct a variety of pieces of furniture, comprising:

a plurality of main elements;

a plurality of connecting elements;

each of said main elements including a plurality of openings therethrough;

each of said main elements having a base width of adequate dimension to allow each of said main elements for freestanding;

each of said connecting elements received in one of said openings of at least two of said main elements thereby connecting said at least two main elements;

means for securing the connection between each of said connecting elements and each of said at least two main elements;

wherein a furniture structure is formed by said connecting elements and said at least two main elements;

said connecting elements and said at least two main elements forming a furniture structure dependent on which of said openings receive said connecting elements; and wherein said connecting elements and said at least two main elements having the capability of being subsequently disassembled and reassembled to form at least a portion of a different furniture structure.

2. The system as in claim 1, wherein a different furniture structure is formed between two of said plurality of main elements.

3. The system as in claim 1, wherein said openings are arranged in a pattern on each of said main elements.

4. The system as in claim 3, wherein:

each of said main elements has an identical opening pattern; and said main elements have corresponding openings.

5. The system as in claim 4, wherein each of said connecting elements rests on said corresponding openings of each of said at least two main elements.

6. The system as in claim 5, wherein each of said main elements has two sides and a width, said width being substantially smaller than the length of each of said two sides.

7. The system as in claim 6, wherein each of said openings extends through said two sides.

8. The system as in claim 7, wherein at least one of said openings has a rectangular shape.

9. The system as in claim 7, wherein at least one of said openings has a triangular shape.

10. The system as in claim 7, wherein at least one of said openings has a semi-circular shape.

11. The system as in claim 6, wherein each of said connecting elements has an elongated shape.

12. The system as in claim 11, wherein each of said two sides has a rectangular shape.

13. The system as in claim 11, wherein each of said two sides has a triangular shape.

14. The system as in claim 11, wherein each of said two sides has a semi-circular shape.

15. The system as in claim 4, wherein said identical opening pattern is a honeycomb pattern.

16. The system as in claim 4, wherein said identical opening pattern is a row and column pattern.

17. The system as in claim 1, wherein said furniture structure comprises a table.

18. The system as in claim 1, wherein said furniture structure comprises a shelf.

19. The system as in claim 1, wherein said furniture structure comprises a chair.

20. The system as in claim 1, wherein said means for securing comprises fasteners fastening said connecting elements to said main elements.

21. The system as in claim 1, wherein said means for securing comprises:

a tight sliding abutment between said connecting elements and said openings;

wherein said connecting elements have a cross-sectional area shape and size;

wherein said openings have a cross-sectional area shape and size;

said connecting element cross-sectional area shape being substantially similar to said opening cross-sectional area shape;

said connecting element cross-sectional area size being slightly smaller than said opening cross-sectional area size;

so that the insertion of said connecting elements into said openings provides a tight sliding abutment therebetween thereby providing structural stability to said system.

22. The system as in claim 1, wherein:

one of said main elements positioned next to a permanent rigid structure;

at least one of said connecting elements extending from said one main element to said permanent rigid structure; and means for securing said at least one of said connecting elements to said permanent rigid structure.

23. A structural assembly system used to construct a variety of pieces of furniture, comprising:

at least one main element;

a plurality of connecting elements;

said at least one main element including a plurality of openings therethrough;

each of said main elements having a base width of adequate dimension to allow each of said main elements for freestanding;

each of said connecting elements received in one of said openings of at least one of said at least one main element;

means for securing the connection between each of said connecting elements and each of said at least one main element;

one of said main elements positioned next to a permanent rigid structure;

at least one of said connecting elements extending from said one main element to said permanent rigid structure;

means for securing said at least one of said connecting elements to said permanent rigid structure;

wherein a furniture structure is formed by said connecting elements and by said at least one main element;

said connecting elements and said at least two main elements forming a furniture structure dependent on which of said openings receive said connecting elements; and wherein said connecting elements and said at least two main elements having the capability of being subsequently disassembled and reassembled to form at least a portion of a different furniture structure.

* * * * *